US005466110A

United States Patent [19]

Redding

[11] Patent Number: 5,466,110

[45] Date of Patent: Nov. 14, 1995

[54] LIFTING DEVICE

[75] Inventor: John W. Redding, Conselice, Italy

[73] Assignee: Perkins Manufacturing Company, Chicago, Ill.

[21] Appl. No.: 115,931

[22] Filed: Sep. 1, 1993

[51] Int. Cl.[6] ..... B65F 3/02

[52] U.S. Cl. ..... 414/421; 414/408; 414/546

[58] Field of Search ..... 414/408, 409, 414/403, 404, 406, 407, 419, 420, 421, 422, 423, 424, 425, 372, 360, 622, 555, 546; 254/8 R, 3 R

[56] References Cited

U.S. PATENT DOCUMENTS

| | | | |
|---|---|---|---|
| 3,732,997 | 5/1973 | Reavis . | |
| 3,738,516 | 6/1973 | Wells . | |
| 3,747,785 | 7/1973 | Dahlin . | |
| 3,804,277 | 4/1974 | Brown . | |
| 3,894,642 | 7/1975 | Shive . | |
| 3,931,901 | 1/1976 | Jones . | |
| 4,042,137 | 8/1977 | Hughes . | |
| 4,365,922 | 12/1982 | Borders | 414/406 |
| 4,422,814 | 12/1983 | Borders | 414/303 |
| 4,479,751 | 10/1984 | Wyman | 414/406 |
| 4,580,940 | 4/1986 | Sheaves | 414/406 |
| 4,673,327 | 6/1987 | Knapp | 414/408 |
| 4,741,658 | 5/1988 | Zelinka | 414/406 |
| 4,773,812 | 9/1988 | Bayne | 414/408 |
| 4,911,600 | 3/1990 | Zelinka | 414/408 |
| 5,024,573 | 6/1991 | Redding | 414/408 |
| 5,069,593 | 12/1991 | Zelinka | 414/408 |
| 5,308,211 | 5/1994 | Bayne | 414/409 X |

FOREIGN PATENT DOCUMENTS

| | | | |
|---|---|---|---|
| 243183 | 10/1965 | Australia . | |
| 622499 | 5/1961 | Canada . | |
| 7916588 | 6/1979 | France . | |
| 2500425 | 8/1982 | France . | |
| 811456 | 8/1951 | Germany . | |
| 1236403 | 3/1967 | Germany . | |
| 2909438 | 9/1979 | Germany | 414/406 |
| 3024081 | 1/1981 | Germany . | |
| 2479783 | 10/1981 | Germany . | |
| 1161432 | 6/1985 | U.S.S.R. | 414/409 |
| 2078196 | 1/1982 | United Kingdom . | |
| 83/03242 | 9/1983 | WIPO . | |

OTHER PUBLICATIONS

Lifting Mechanism for a Sanitation Vehicle, U.S. patent application Ser. No. 378,823, filed May 12, 1982, now abandoned (bearing production Nos. B984–1005), with photographs (dated Dec., 1981) (bearing production Nos. B1082–1097), photographs of a present version of the above cited reference (bearing production Nos. B1098–1107, B1109–1110), and other related documents (bearing production Nos. 935–947, 949–983, 1006–1025 and 1111–1125).

Refuse Removal Systems, Inc. "Waste Wheeler", *Waste Age*, 1982 (with photographs of the device bearing production Nos. B913–914, B917–922).

McKagen, *World Wastes*, "Supercan! Can . . . And Does", Jun. 1983, pp. 24–26.

*Waste Age*, Mar. 1982, pp. 31–33.

Bayne, "Bayne Thinline Premium Lift Systems", (four-page color brochure).

Bayne, "Bayne Thinline Premium Lift Systems: Chart Lifter Guide", (thirteen-page black and white folded brochure).

*Primary Examiner*—Frank E. Werner

*Attorney, Agent, or Firm*—Cook, Egan, Mc Farron & Manzo, Ltd.

[57] ABSTRACT

A lifting device for lifting and dumping refuse receptacles into the cavity of a refuse collection vehicle. The lifter has upper and lower engagement members movable between first and second spaced apart positions for capturing the receptacle lifting handles to lift and invert the receptacle without unduly spreading apart the handles. The lower engagement member of the lifter is movable and resiliently biased in an extended position so as to yield upon contact with the common exterior wall of the refuse receptacle.

4 Claims, 7 Drawing Sheets

LIFTING DEVICE

The present invention generally relates to lifting devices for dumping refuse receptacles into the cavity of a refuse receiving container or into a vehicle of the type using so-called "tipper bars" for inverting and dumping larger commercial containers. More particularly the present invention relates to a refuse receptacle lifter that does not interfere with the operation of the tipper bar and reduces damage often imparted to refuse receptacles when the receptacles are lifted and dumped into the cavity of a refuse receiving container or vehicle.

BACKGROUND OF THE INVENTION

It has been a common practice in the refuse collection industry for a single refuse receiving vehicle to service both residential and commercial establishments. Traditionally, residential refuse receptacles were approximately thirty gallon containers, which the vehicle operator lifted by hand to dump into the refuse receiving cavity of the vehicle. In contrast, commercial refuse containers are typically much larger steel containers, often two cubic yards or greater, and commonly referred to as "dumpsters." These containers are typically pivot-dumped into the refuse receiving cavity by mechanically tipping the container over the rear edge of the refuse receiving cavity. Such containers are usually tipped by a cable and winch or by a hydraulically actuated tipper bar that rotates and lifts the container.

More recently, it has become popular in some residential areas to use larger, plastic roll-out refuse receptacles that have a capacity of approximately ninety gallons. Typically these refuse receptacles have two lifting handles along a common exterior receptacle wall, and two wheels for convenience in moving the receptacle. As a result of the greatly increased size over prior residential receptacles, the roll-out residential receptacles are not easily lifted by hand. This has given rise to the development and use of refuse receptacle lifters specifically made for the newer larger roll-out receptacles.

An example of a commercially successful refuse receptacle lifter for use with the larger roll-out residential receptacles can be seen, for example, in U.S. Pat. No. 5,069,593. The lifter, as generally shown in the patent, has been marketed as the "Tuckaway" dumper by Perkins Mfg. Co. of Chicago, Ill. This lifter may be retracted to a lower position, where it does not interfere with the dumping of commercial containers by cable and winch. However, the particular Tuckaway lifter shown in the patent cannot be used on a vehicle equipped with a tipper bar for dumping commercial containers, because the lifter would obstruct the path of movement of the tipper bar.

A receptacle lifter has been designed to work in concert with the movement of a tipper bar. Such a lifter is disclosed in abandoned U.S. patent application Ser. No. 378,823, filed May 12, 1982 and entitled Lifting Mechanism for a Sanitation Vehicle. The lifter shown in that application has been used commercially and includes a plate which pivots at its upper end at the rear edge of the refuse receiving cavity and is pushed upward by activation of the tipper bar itself. However, while this lifter does not prevent the movement of the tipper bar, actuation of the lifter to dump residential receptacles requires full activation of the tipper bar mechanism, which consequently causes a significant increase in the number of times the tipper bar must be cycled. This, in turn, may result in higher maintenance costs and decreased life expectancy for the tipper bar hardware. Also, the tipper bar cycle time is often greater than the desired cycle time for a receptacle lifter, therefore increasing the time required for refuse collection.

At least one manufacturer, Bayne Machine Works, Inc., of Simpsonville, S.C., markets a receptacle lifter that has its own hydraulic drive and is capable of use with a vehicle equipped with a tipper bar. The Bayne lifter exhibits certain features common among the prior art; specifically, the means for engaging the lifting handles of the roll-out residential receptacles includes an upper hook for lifting an upper lifting handle on the receptacle and a lower hook which engages over a lower handle on the receptacle to keep the receptacle from falling into the vehicle cavity when the receptacle is inverted for dumping.

With the Bayne lifter, the lower hook retracts to a raised position when the lifter is lowered in order to allow passage of the tipper bar beneath the lifter. As a roll-out residential receptacle is being lifted and inverted, the lower hook moves downwardly to engage the lower receptacle handle. However, a shortcoming of the Bayne dumper is that the lower hook continues to move even after having engaged the lifting handle of the receptacle. This continued movement may impart undue stress on the handles, resulting in bending the handles or breaking the receptacle.

Another example of a receptacle lifter for use with a vehicle equipped with a tipper bar can be seen in U.S. Pat. No. 4,673,327 to Knapp entitled "Waste Receptacle Dumping Apparatus." The Knapp patent discloses a device that has upper and lower hooks that move apart during the initial portion of the lifting cycle to engage the lifting handles of a rollout receptacle and then do not move appreciably further apart over the remaining pivotal movement. However, the lifter shown in Knapp is directly pivotally attached to the mounting support at the cavity opening. Direct pivotal attachment limits the height and forward displacement attainable by the dumping apparatus for reaching forward into the cavity to dump receptacles. The inherent reach limitations of the Knapp device result in the refuse being dumped close to the rearward edge of the cavity. This, in turn, may create a need for more frequent cycling of the vehicle's refuse compacting equipment in order to keep the refuse from falling out of the vehicle. More frequent cycling of the compacting equipment, of course, requires additional operator time.

Another drawback common with prior art receptacle lifters is that the lower engagement hook projects a fixed distance from the face of the lifter, and is unable to adapt to potential variations in receptacle dimensions, e.g., variations in the space between the receptacle wall and the lower handle or in the particular shape of the receptacle wall adjacent the handle. Because the lower handle of the receptacle is not always the same distance from the container wall, the projecting lower hook of prior art receptacle lifters may actually puncture the side wall of a receptacle, or downward movement of the hook may scrape or tear the side wall.

SUMMARY OF THE INVENTION

The present invention is generally embodied in an improved receptacle dumping apparatus for emptying a refuse receptacle more deeply into the cavity of a refuse receiving container or vehicle without causing undue damage to the receptacle lifting handles or to the side wall on which the lifting handles are configured, and without interfering with conventional tipper bar dumping of large commercial receptacles.

In accordance with one novel aspect of the present invention, a receptacle dumping apparatus is provided for dumping a refuse receptacle of the type having upper and lower engagement surfaces, such as handles, for example. The receptacle dumping apparatus of the present invention comprises a receptacle lifter including means for capturing and releasing the refuse receptacle, a mounting support and a drive system for moving the lifter between a lower first position and a raised inverted second position for dumping the receptacle. The capture and release means comprise upper and lower engagement members that are relatively movable between a first spaced apart position, wherein the engagement members are spaced apart a distance less than the distance between the upper and lower engagement surfaces of the receptacle, and a second spaced apart position, wherein the engagement members are spaced apart farther than in said first spaced apart position so as to capture the engagement surfaces of the receptacle to prevent the receptacle from falling from the lifter when inverted. The drive system of the receptacle dumping apparatus comprises a drive arm which carries the upper engagement member. A follower arm is pivotally attached to the mounting support and is cooperative with the lower engagement member. The receptacle dumping apparatus still further comprises a linkage system cooperatively associated with the mounting support, the drive arm and the lower engagement member for moving at least one of the engagement members between the first and second spaced apart positions as the lifter moves between the lower first position and a position intermediate the lower first position and the raised inverted second position. After the engagement members reach the second spaced apart position, the distance between them is maintained essentially constant as the lifter moves between the intermediate position and the raised inverted second position. In accordance with this aspect of the invention, undue force is not imparted on the receptacle handles due to continued spreading of the engagement members.

In accordance with another aspect of the present invention a receptacle dumping apparatus is provided for dumping a refuse receptacle of the type described above (having upper and lower engagement surfaces located relative to a common exterior wall of the refuse receptacle) without damage to the receptacle wall. This receptacle dumping apparatus of the present invention comprises a receptacle lifter including means for capturing and releasing the refuse receptacle, with the lifter being movable between a lower first position and a raised inverted second position for dumping the receptacle. The capture and release means include upper and lower engagement members, with the lower engagement member projecting from the lifter and being movable and resiliently biased toward an extended position so as to yield upon contact with the common exterior wall of the refuse receptacle when the receptacle is to be lifted by the lifter. With this feature, damage to the receptacle wall is minimized.

Further features and objects of the present invention will become more fully apparent in the following description of the preferred embodiment of this invention and from the appended claims.

DESCRIPTION OF THE DRAWINGS

In describing the preferred embodiment, reference is made to the accompanying drawings wherein like parts have like reference numerals, and wherein.

DESCRIPTION OF THE PREFERRED EMBODIMENT

Figure 1:
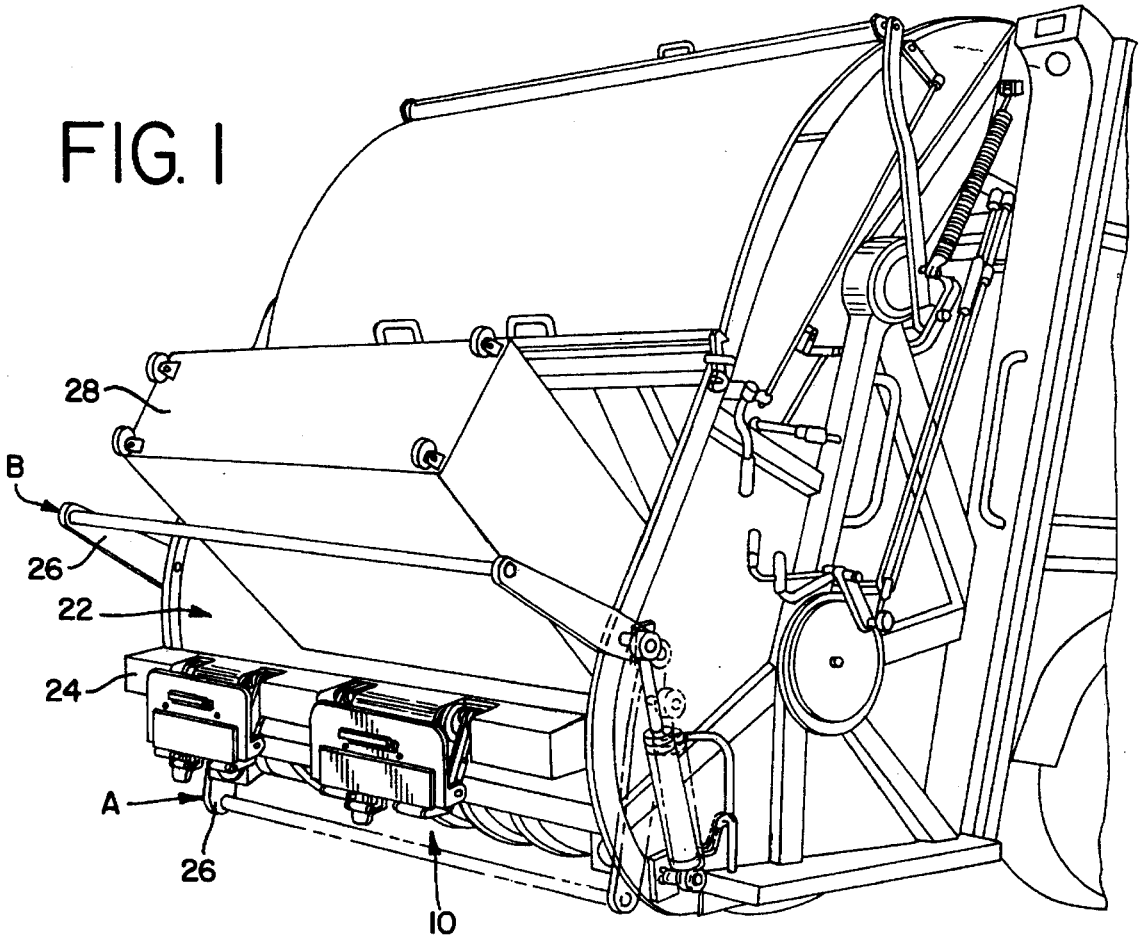
FIG. 1 is a fragmentary perspective view of the rear of a refuse collection vehicle including two lifters of the present invention in a first, lower position while a larger commercial container is being dumped with a tipper bar.
Figure 2:
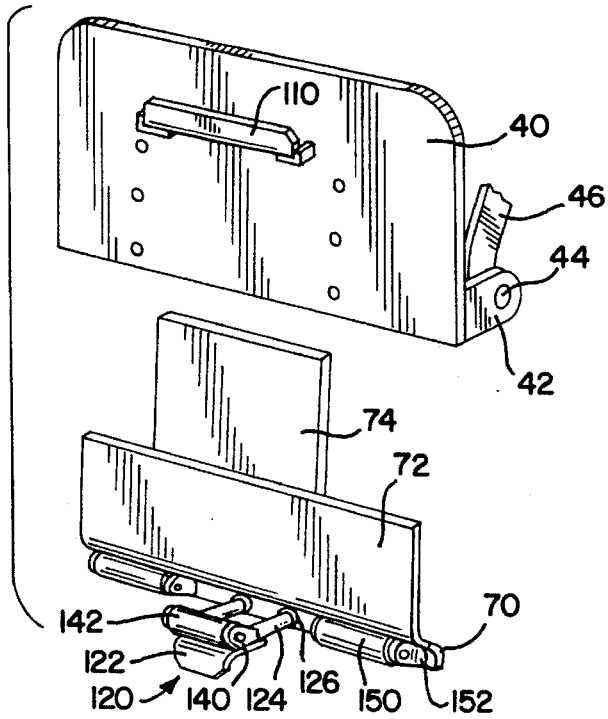
FIG. 2 is an expanded fragmentary perspective view illustrating the face plates of one of the lifters of FIG. 1.

Referring now to FIG. 1, the present invention is generally embodied in a receptacle lifter 10 which may be mounted to a refuse collection container or to a vehicle 20 having a refuse receiving cavity 22 with a rear edge 24 and a tipper bar assembly 26 for pivot-dumping large commercial refuse containers 28 over the rear edge 24 into the refuse receiving cavity 22 of the vehicle 20. The lifter 10 may be mounted adjacent the rear edge 24 of the refuse receiving cavity 22 and, as shown, more than one receptacle lifter 10 may be provided for most efficient collection. It will also be apparent that, in keeping with the invention, the receptacle lifter 10 may be mounted in various arrangements to refuse collection apparatus. For example, the lifter 10 may be mounted to the rear of a refuse collection vehicle not equipped to dump larger commercial containers, or to a vehicle having a side opening refuse receiving cavity. By way of further example, the lifter 10 may similarly be mounted to a stand-alone larger refuse container having a refuse receiving cavity.

As shown in FIG. 1, the lifter 10 preferably is located in a first lower position sufficiently beneath and forward of the rear edge 24 of the refuse receiving cavity 22 and sufficiently above the tipper bar 26 when the tipper bar is in its lower position A such that access to the rear edge 24 is permitted to pivot-dump large commercial refuse containers 28 by raising the tipper bar 26 to its raised position B without substantial interference from the lifter.

Figure 3:
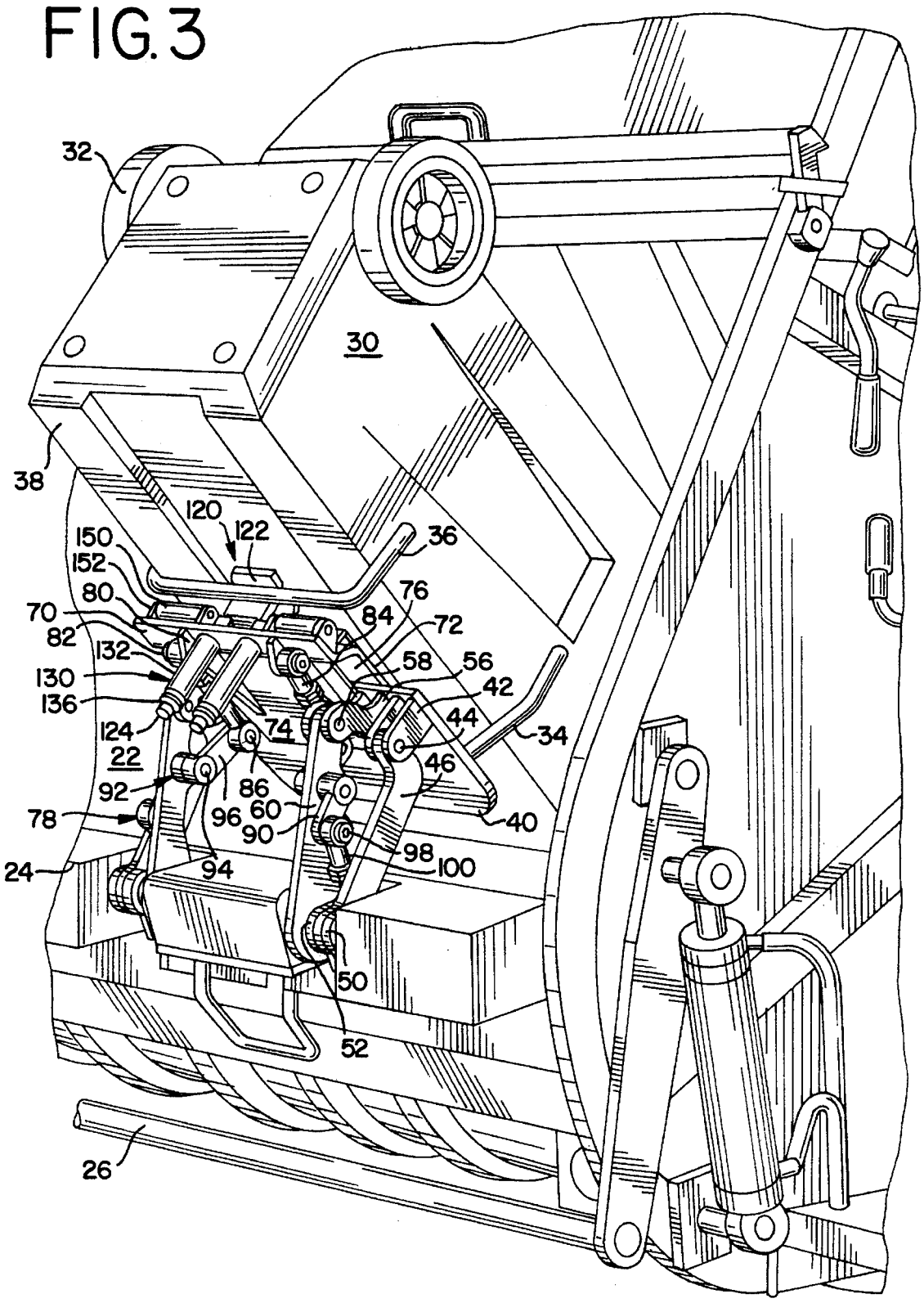
FIG. 3 is a fragmentary perspective view illustrating a lifter of the present invention in the raised inverted position dumping a roll-out residential refuse receptacle.

Referring to FIG. 3, the roll-out receptacle 30 with which the receptacle lifter 10 operates is shown inverted. The receptacle is made of molded plastic and has a pair of wheels 32 for ease of transportation, and an upper lifting handle 34 and a lower lifting handle 36 which are located relative to a common exterior wall 38 of receptacle 30.

Figure 6:
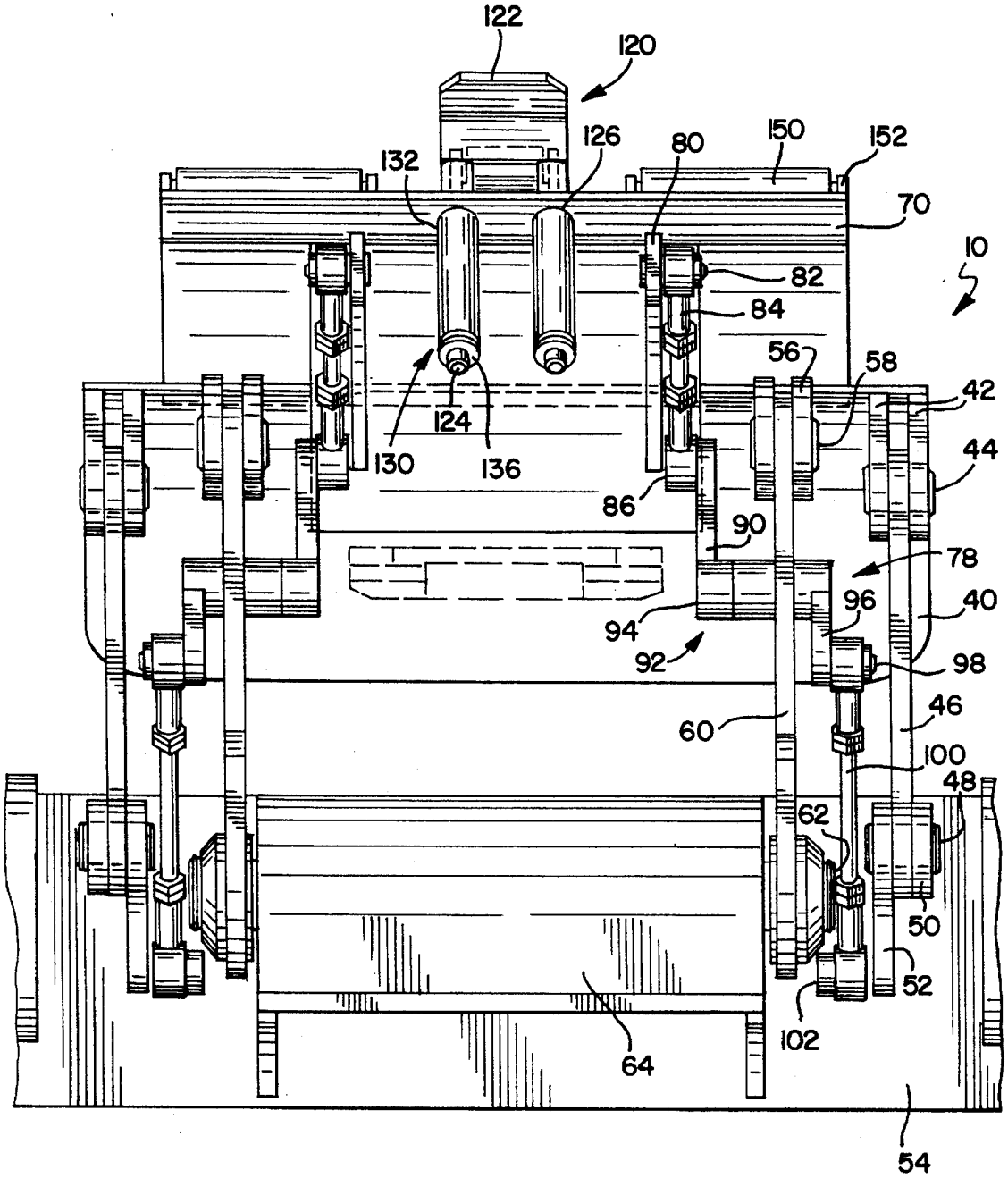
FIG. 6 is a fragmentary frontal view illustrating a lifter of the present invention in the raised inverted position.
Figure 7:
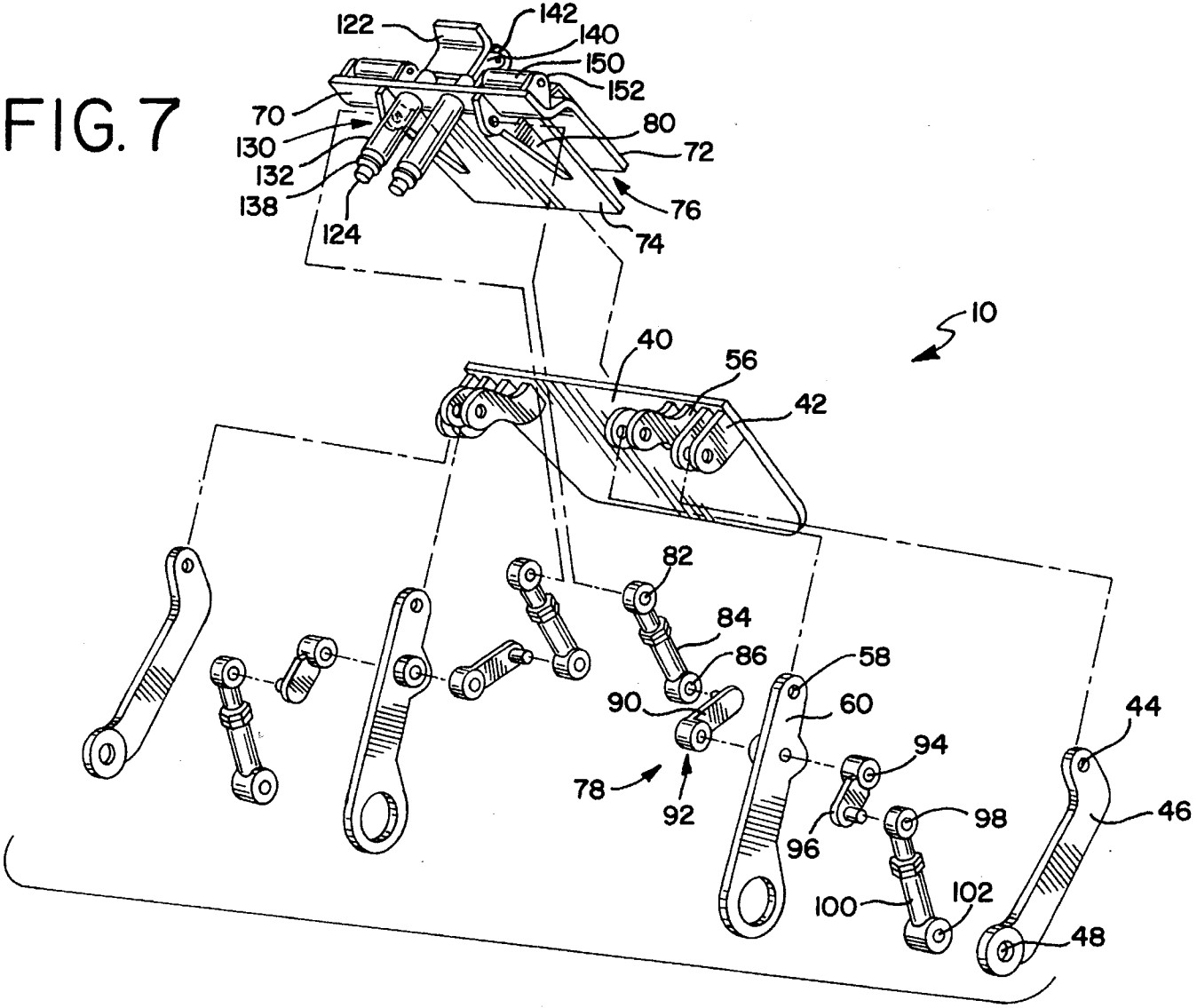
FIG. 7 is an exploded perspective view illustrating a lifter of the present invention in the raised inverted position.

Referring to FIGS. 2, 3, 4D and 6 the lifter 10 has a first face plate 40 having two pair of mounting supports 42 by which it is pivotally connected at pivot points 44 to the ends of a pair of follower arms 46. As best seen in FIG. 6, each follower arm 46 is pivotally connected at its other end at a respective pivot point 48, between an outer mounting support 50 and the upper portion of an inner mounting support 52. Mounting supports 50 and 52 are fixedly attached to mounting support 54 which is fixedly mounted to vehicle 20 as by welding or bolting.

Face plate 40 has another two pair of mounting supports 56 by which it is pivotally connected at pivot points 58 to the ends of a pair of drive arms 60. Each drive arm 60 is fixedly connected at its other end to one end of the output shaft 62 of a hydraulic drive motor 64. The hydraulic drive motor is preferably a helical hydraulic rotary actuator, such as the H Series rotary actuator available from Helac Corporation, of Enumclaw, Wash., although other alternative devices capable of electrically or hydraulically imparting rotary motion would be considered within the skill in the art.

Referring to FIGS. 2, 3, 4D and 7, in particular, the lifter 10 also has a second face plate 70 having a face portion 72 and a rearward flange portion 74 which form an upwardly opening recess 76 therebetween. The lower edge of face plate 40 is slidably located within recess 76 of the second face plate 70. The face plates 40 and 70 are held together in sliding engagement by the bell crank linkage 78 which also controls the depth by which the face plate 40 extends into recess 76.

Figure 4B:
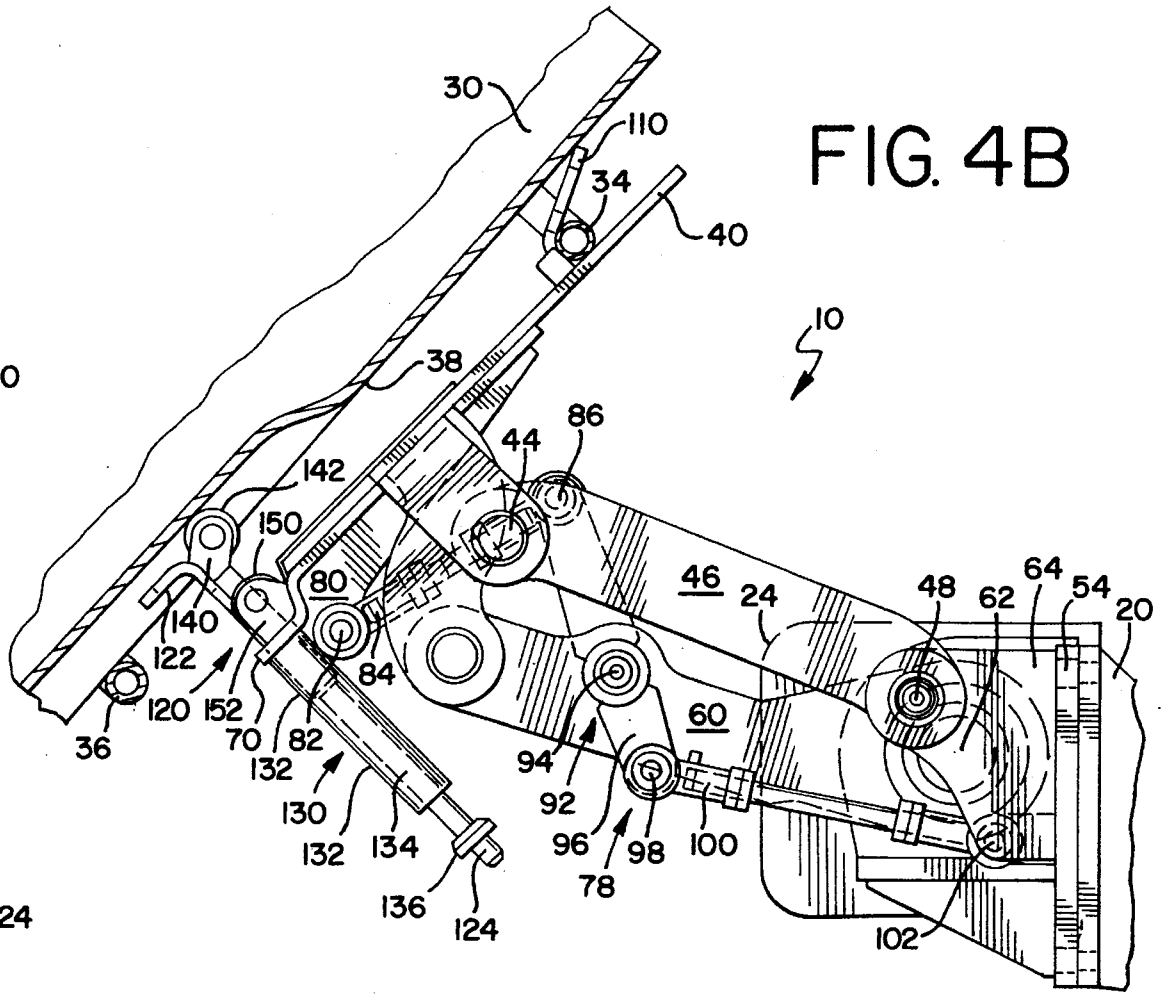
FIGS. 4A–4D are diagrammatic views illustrating the operation of the lifter of the present invention, with the side wall of a roll-out residential refuse receptacle shown in section.
Figure 4A:
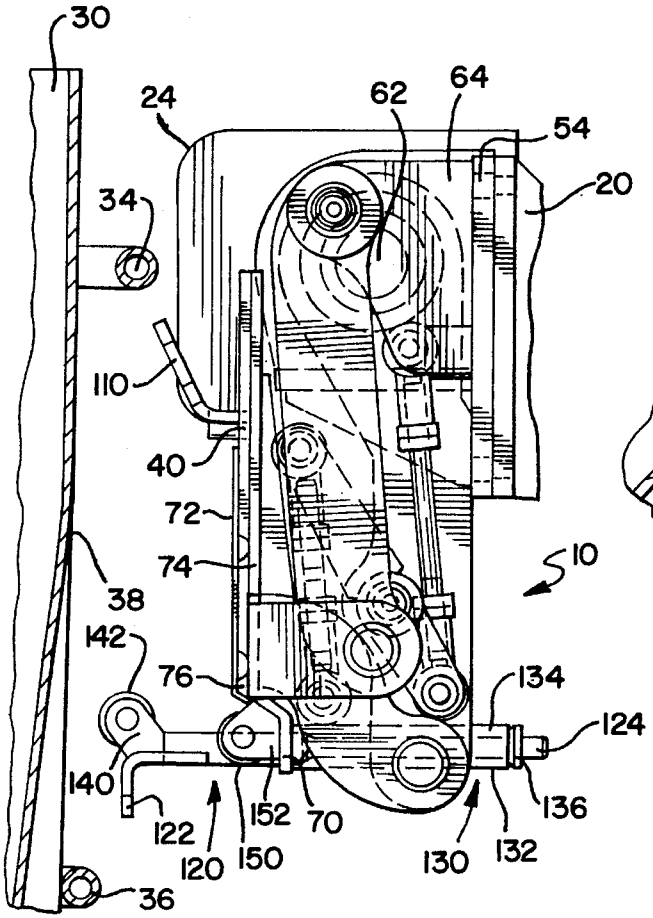
Figure 4D:
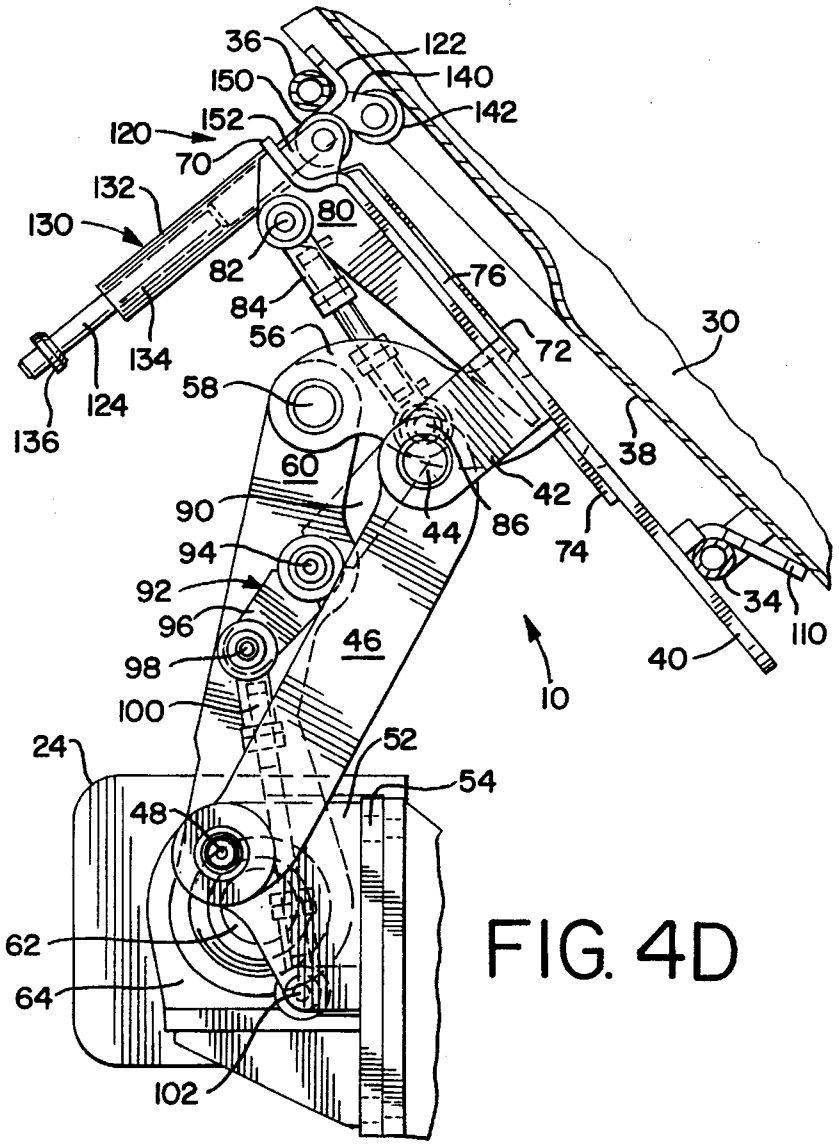

The bell crank linkage 78 is shown in FIGS. 3, 4D and 6. Specifically, as best seen in FIG. 6, second face plate 70 has a pair of mounting supports 80 by which the second face plate 70 is pivotally connected at pivot points 82 to the ends of a pair of first links 84. Each first link 84 is pivotally connected at its other end at a respective pivot point 86 to a first arm 90 of a bell crank 92. Each of the two bell cranks 92 is pivotally mounted at 94 to a drive arm 60 and has a second arm 96 pivotally connected at pivot point 98 to one of a pair of second links 100. Each second link 100 is pivotally connected at its other end at a respective pivot point 102 to the lower portion of one of the inner mounting supports 52.

Referring to FIGS. 2, and 4A–4D, first face plate 40 has an outwardly and upwardly extending upper hook member 110 fixedly attached to face plate 40 for lifting the upper lifting handle 34 of the receptacle 30. Second face plate 70 has a lower hook member 120 having an outwardly and downwardly extending hook portion 122 and a pair of extension rods 124. The extension rods 124 pass through a pair of holes 126 in second face plate 70 and through a pair of biasing means 130 fixedly attached to the rear of face plate 70.

The biasing means 130, as shown in the preferred embodiment have outer sleeves 132 and inner resilient members 134, such as springs, for biasing lower hook member 120 in a position projecting outwardly from the face plate 70. It will be understood that biasing means 130 may comprise other biasing devices such as gas charged struts, hydraulic shock absorbers, or the like. Stop rings 138 attached to the ends of extension rods 124 of lower hook member 120, limit the biased projection of hook portion 122 from the front of face plate 70.

To further limit possible damage to the refuse receptacle, lower hook member 120 also has a roller 142 mounted between a pair of mounting supports 140 that are fixedly attached to its hook portion 122. Roller 142 reduces the potential damage to the receptacle 30 by preventing hook portion 122 from actually contacting the exterior wall 38 of receptacle 30. Roller 142 also reduces the friction between hook member 120 and exterior wall 38 of receptacle 30 when hook member 120 moves relatively downward to capture lower lifting handle 36 of the receptacle 30.

A pair of rollers 150 on the second face plate 70 flank the hook member 120. The front of second face plate 70 has two pair of mounting supports 152 fixedly attached to its face and rollers 150 are movably attached between each respective pair of mounting supports 152.

In operation, the lifter 10 is initially located in a first lower position beneath and forward of the rear edge 24 of the refuse receiving cavity 22 of the vehicle 20 as shown in FIGS. 1 and 4A. In this position, slidably engaged face plates 40 and 70 are in a first retracted position. In order to initiate the dumping operation, the roll-out receptacle 30, shown in partial cross section in FIG. 4A, is moved to a position behind the vehicle 20 and immediately behind the lifter 10. In this first lower position, the upper hook member 110 on first face plate 40 and the lower hook member 120 on second face plate 70 are spaced apart a distance less than the distance between upper lifting handle 34 and lower lifting handle 36 of the roll-out receptacle 30.

Referring now to FIGS. 4A–4D, as the hydraulic drive motor 64 is energized, the output shaft 62 causes the drive arms 60 to rotate about the axis of the output shaft 62, moving lifter 10 outward and upward from beneath rear edge 24. In moving from the first lower position, the upper hook member 110 of lifter 10 catches and lifts the upper lifting handle 34 of the receptacle 30, and the roller 142 of the lower hook member 120 contacts the common exterior wall 38 of the receptacle 30. Upon contact with the exterior wall 38 of receptacle 30, the biasing means 130 of lower hook member 120 allow hook portion 122 to retract or be moved relatively closer to face plate 70. Roller 142 of lower hook member 120 spaces hook portion 122 from the exterior wall 38 of receptacle 30 and prevents hook portion 122 from contacting the exterior wall 38 of receptacle 30 while the receptacle 30 is being lifted by lifter 10.

As the drive motor 64 continues to move the lifter 10 away from the first lower position, the drive arms 60 initially move the lifter 10 outward and upward. As the lifter 10 is moved by drive arms 60, follower arms 46 pivot at their ends at pivot points 44 and 48. Follower arms 46 control the relative angle of the slidably engaged face plates 40 and 70 with respect to the substantially vertical orientation of the face plates 40 and 70 when in the first lower position. Thus, as shown in FIG. 4B, as the lifter 10 continues to move upward, follower arms 46 cause the face plates 40 and 70 to tilt forward toward the vehicle 20.

The upward movement of the lifter 10 also causes the second face plate 70 to move relatively downward from the upper face plate 40. Specifically, as the drive arms 60 pivot upward, the location of pivot points 102 below the motor drive shaft 62 causes the links 100 to pull the arms 96 of the bell cranks 92. The pulling of links 100 causes the bell cranks 92 to rotate counter clockwise about pivot points 94 and, in turn, causes the first arms 90 of the bell cranks to push first links 84 and the attached face plate 70 relatively downward.

The relative downward movement of face plate 70 with respect to face plate 40 correspondingly makes the upper hook member 110 of first face plate 40 and the lower hook member 120 of second face plate 70 move relatively farther apart.

While face plates 40 and 70 move relatively farther apart, rollers 150 help to prevent the face plate 70 from scraping the exterior wall 38 of receptacle 30. Similarly, as shown in FIG. 4B, roller 142 on lower hook member 120 remains in contact with exterior wall 38 and helps to prevent the hook portion 122 of lower hook member 120 from scraping exterior wall 38 of receptacle 30.

Figure 4C:
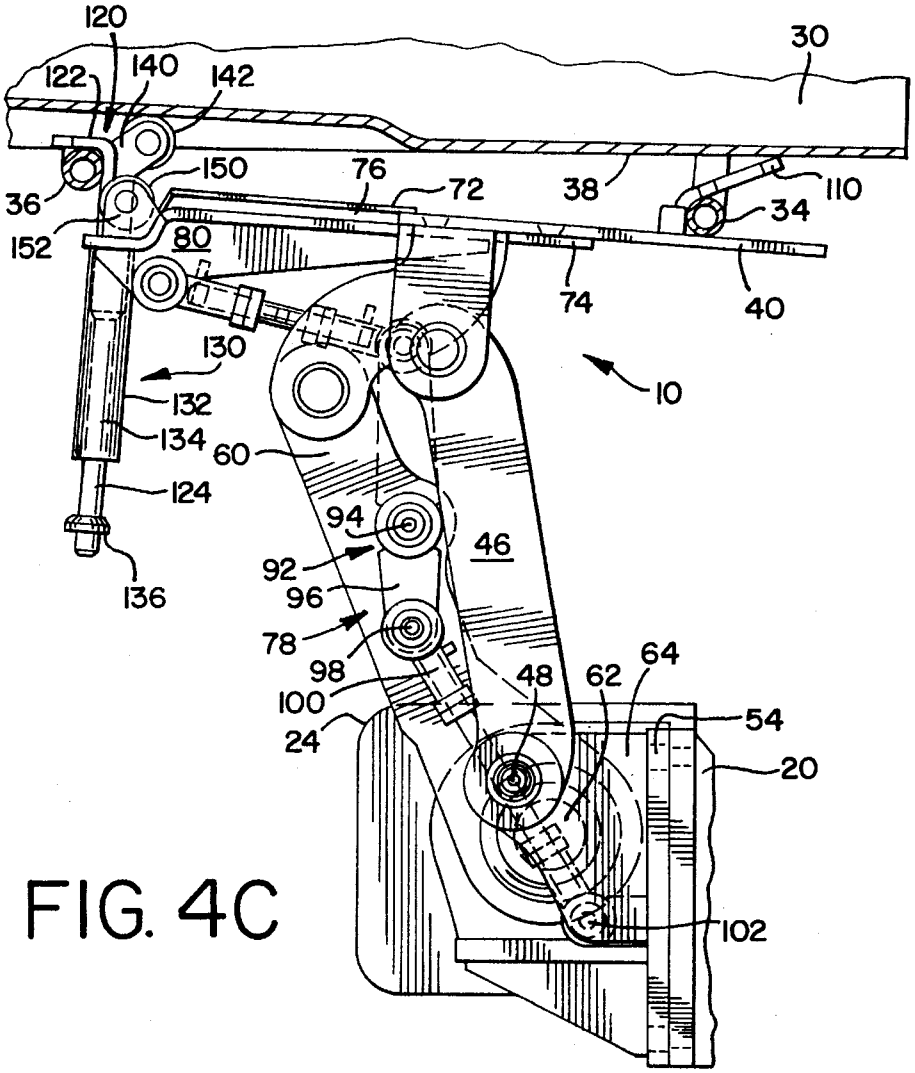

Continued rotation of output shaft 62 of drive motor 64 continues to lift and tilt the lifter 10 and continues to move hook members 110 and 120 farther apart until lifter 10 reaches a predetermined intermediate position, generally depicted in FIG. 4C. At this position, upper hook member 110 and lower hook member 120 reach a spaced apart position in which hook portion 122 of lower hook member 120 captures the lower lifting handle 36 of the receptacle 30 to keep the receptacle 30 from falling into the refuse receiving cavity 22 as the receptacle 30 is further inverted and emptied.

This distance between upper hook member 110 and lower hook member 120 is maintained substantially constant as the lifter 10 moves from the intermediate position generally depicted in FIG. 4C to the fully raised and inverted position in FIG. 4D. During this phase of the lifting cycle, the second links 100 do not exert substantial pull on the bell cranks 92. Specifically, during this phase, second links 100 cross the axis of rotation of the output shaft 62 of the hydraulic motor 64. As a result of the substantially co-linear orientation of the second links 100 and drive arms 60 during this phase of the cycle, the distance between pivot points 94 of bell cranks 92 and the pivot points 102 of second links 100 is maintained substantially constant and any slight change is insufficient to exert undue pressure on the lifting handles 34 and 36. Therefore, the bell cranks 92 do not continue to rotate significantly about pivot points 94 and first links 84 and correspondingly linked second face plate 70 are not pushed substantially farther downward relative to face plate 40.

Hence, upper hook member 110 on first face plate 40 and lower hook member 120 on second face plate 70 remain substantially in the second spaced apart position while the lifter 10 moves from the intermediate position generally shown in FIG. 4C to the raised inverted position in FIG. 4D in which the lifter 10 reaches forward of the rearward edge 24 of the refuse receiving cavity 22. By maintaining the distance between upper hook member 110 and lower hook member 120 essentially constant during this phase of the lifting cycle, undue force is not imparted on the receptacle handles 34 and 36 due to continued spreading of the engagement members.

It will be apparent that the hook portion 122 need not actually engage the lower handle 36 of the receptacle 30 as the upper hook member 110 and the lower hook member 120 move farther apart. Specifically, if the downward projection of the lower hook portion 122 is sufficiently long, the lower hook member 120 can capture the lower handle 36 without engaging the top of the lower handle 36 by trapping lower handle 36 between the downward projection portion of lower hook portion 122 and the exterior wall 38 of the receptacle 30. Regardless of whether hook portion 122 engages the top of lower handle 36 when hook members 110 and 120 initially reach their maximum spaced apart position, the lower hook portion 122 will eventually engage the top surface of the lower lifting handle 36 when the lifter 10 reaches over the rearward edge 24 and forward into the refuse receiving cavity 22 and receptacle 30 is inverted and gravity pulls the inverted receptacle 30 downward toward refuse receiving cavity 22. Hence, lower hook member 120 will eventually engage lower handle 36 to keep the receptacle 30 from falling into the refuse receiving cavity 22.

After dumping the contents of receptacle 30 the cycle is reversed. The reversed rotation of output shaft 62 of drive motor 64 causes the downward movement of lifter 10. Lifter 10 moves from the raised inverted position reaching over the rearward edge 24 and forward into the cavity 22 shown in FIG. 4D, through the intermediate position in FIG. 4C and the other raised position shown in FIG. 4B. The relative movement of face plates 40 and 70 and the corresponding relative movement of upper hook member 110 and lower hook member 120 as described above is reversed, and the distance between the upper hook member 110 and lower hook member 120 remains constant between the raised inverted position in FIG. 4D and the intermediate position generally shown in FIG. 4C. As the lifter 10 continues to move downward from the intermediate position, upper hook member 110 and lower hook member 120 move relatively closer together.

As the lifter 10 moves downward through a raised position as generally shown in FIG. 4B to the first lower position depicted in FIG. 4A, the follower arms 46 continue to reverse the tilted orientation of the face plates 40 and 70 to a substantially upright position. Further downward movement of lifter 10 causes receptacle 30 to be placed on the ground. Once the receptacle 30 has been placed on the ground, lifter 10 continues to move downward, releasing upper hook member 110 from its engagement with upper lifting handle 34 of receptacle 30. The lifter 10 then continues to move downward and inward until lifter 10 returns to the first lower position below and forward of the rear edge 24 as shown in FIG. 4A. This method of disengagement of the upper hook member 110 from the upper lifting handle 34 of receptacle 30 conveniently leaves the receptacle 30 freestanding behind the refuse collection vehicle 20.

In accordance with the present invention, the relative outward and upward initial movement of the lifter 10 during the lifting portion of the dumping cycle enables the lifter 10 to compensate for variations in the height of the vehicle 20 as additional refuse is loaded into the refuse receiving cavity 22, or for variations in the relative height of the ground surface on which vehicle 20 and receptacle 30 initially rest.

Figure 5A:
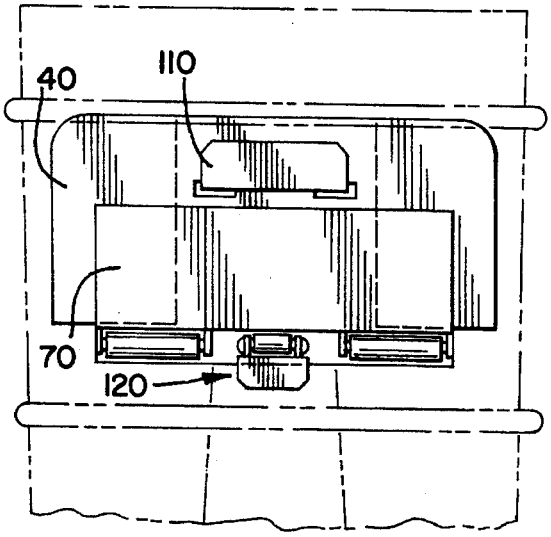
FIGS. 5A–5D are frontal views illustrating the respective positions of the face plates of the lifter in the positions shown in FIGS. 4A–4D.
Figure 5B:
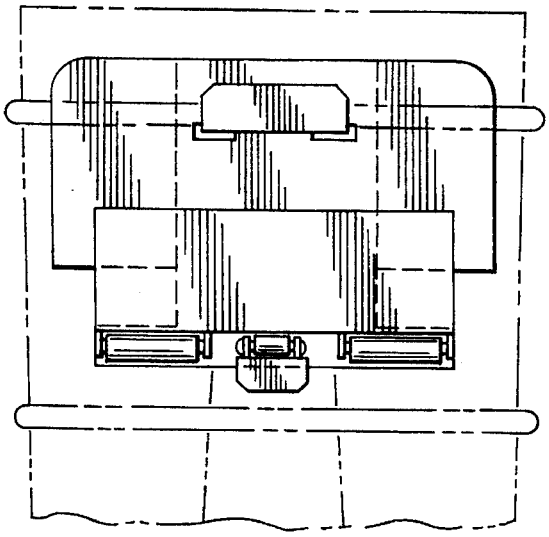
Figure 5C:
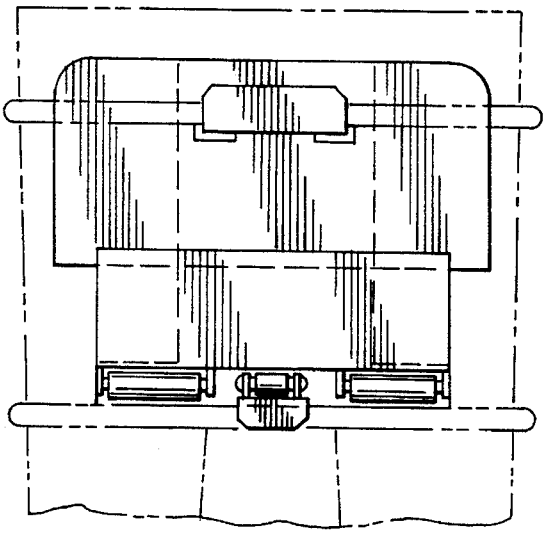
Figure 5D:
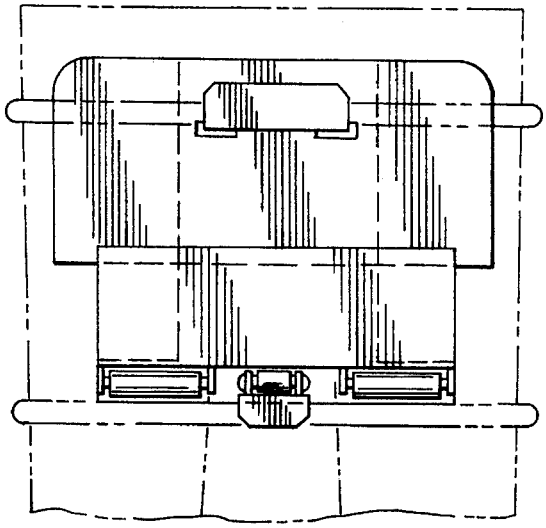

FIGS. 5A–5D are consecutive frontal views of the face plates 40 and 70 of lifter 10 showing the relative positions of face plates 40 and 70 and their respective hook members 110 and 120 as the lifter 10 moves from the first lower position to the raised inverted position reaching over the rearward edge 24 and forward into the cavity 22. FIG. 5A specifically shows a frontal view of the face plates 40 and 70 and their respective hook members 110 and 120 in the first spaced apart position. As the lifter 10 moves to the position shown in FIG. 5B it can be seen that the hook members 110 and 120 are relatively farther apart than in FIG. 5A. When lifter 10 reaches the intermediate position generally shown in FIG. 5C, the hook members 110 and 120 achieve a second spaced apart position. This second spaced apart position of hook members 110 and 120 is maintained essentially constant as the lifter 10 moves from the intermediate position shown in FIG. 5C to the raised inverted position reaching forward into the cavity 22 of FIG. 4D that corresponds to the frontal view of face plates 40 and 70 shown in FIG. 5D.

Although the present invention has been described in terms of the preferred embodiment, various modifications, some immediately apparent, and others apparent only after some study, may be made without departing from the present invention. The scope of the present invention is not to be limited by the detailed description of the preferred embodiment but, rather, is to be defined by the claims appended below.

What is claimed is:

1. Receptacle dumping apparatus for dumping refuse receptacle having upper and lower engagement surfaces spaced a certain distance apart, said receptacle dumping apparatus comprising:

a receptacle lifter comprising upper and lower engagement members, said upper and lower engagement members being relatively slidably movable between a first spaced apart position, wherein said engagement members are spaced apart a distance less than the certain distance between the upper and lower engagement surfaces of the receptacle, and a second spaced apart position, wherein said engagement members are spaced farther apart than in said first spaced apart position so as to capture the engagement surfaces of the receptacle to prevent the receptacle from falling from said lifter when inverted;

a mounting support;

a drive arm having first and second ends, said first end being pivotally carried on said mounting support and said second end being pivotally carried on said lifter;

a follower arm having first and second ends, said first end of said follower arm being pivotally carried on said mounting support and said second end of said follower arm being pivotally carried on said lifter;

means for pivoting said drive arm about said first end thereof to move said lifter between a lower first position, wherein said engagement members are in said first spaced apart position for initially engaging a refuse receptacle, and a raised and inverted second position wherein said engagement members are in said second spaced apart position for dumping a refuse receptacle; and a plurality of linkages pivotally connected to said mounting support, to one of said drive and follower arms and to one of said engagement members to cause relative movement of said engagement members between said first and second spaced apart positions as said lifter moves between said lower first position and a position intermediate said lower first position and said raised inverted second position, said linkages maintaining the distance between said upper and lower engagement members in said second spaced apart position essentially constant as said lifter moves between said intermediate position and said raised inverted second position.

2. The dumping apparatus of claim 1 wherein said lifter further comprises upper and lower slidably associated face plates and wherein said upper engagement member is carried on said upper face plate and lower engagement member is carried on said lower face plate.

3. The dumping apparatus of claim 2 further comprising:

a rotary actuator carried by said mounting support;

said drive arm first end being attached to said rotary actuator and said drive arm second end being pivotally attached to said upper face plate;

said follower arm first end being pivotally attached to said mounting support and said follower arm second end being pivotally attached to said upper face plate; and said plurality of linkages including first, second and third linkages, said first linkage being pivotally connected to said mounting support, said second linkage being pivotally connected to said one of said drive and follower arms and said third linkage being pivotally connected to said one of said face plates.

4. The dumping apparatus of claim 3 wherein said second linkage includes a first end and a second end, said second linkage being pivotally attached to said drive arm at a point between said first linkage's first and second ends of said first linkage; said first linkage includes a first end and a second end, said first linkage first end being pivotally attached to said mounting support, said first linkage second end being pivotally attached to said second linkage first end; and said third linkage includes a first end and a second end, said third linkage second end being pivotally attached to said second linkage second end and said third linkage first end being pivotally attached to said lower face plate.

* * * * *